US006889866B2

(12) United States Patent
Gilliam et al.

(10) Patent No.: US 6,889,866 B2
(45) Date of Patent: May 10, 2005

(54) CONTAINER FOR SPOONABLE FOOD PRODUCTS

(75) Inventors: Cheryl Marie Gilliam, Grayslake, IL (US); Anne Bucher, Palatine, IL (US); Lori Ann Rothman, Oak Park, IL (US); Kadir Karul, Racine, WI (US)

(73) Assignee: Kraft Foods Holdings, Inc., Northfield, IL (US)

( * ) Notice: Subject to any disclaimer, the term of this patent is extended or adjusted under 35 U.S.C. 154(b) by 18 days.

(21) Appl. No.: 10/153,077

(22) Filed: May 22, 2002

(65) Prior Publication Data

US 2003/0218020 A1 Nov. 27, 2003

(51) Int. Cl.[7] ..... B65D 6/08
(52) U.S. Cl. ..... 220/675; 215/383
(58) Field of Search ..... 220/672, 675, 220/755, 669; 215/382, 383, 384, 374, 377, 373

(56) References Cited

U.S. PATENT DOCUMENTS

| | | | | | |
|---|---|---|---|---|---|
| 685,900 | A | | 11/1901 | Anderson | |
| 827,124 | A | * | 7/1906 | Speer | 220/509 |
| 1,943,979 | A | * | 1/1934 | Lundvall | 220/673 |
| 3,246,792 | A | | 4/1966 | Brackman et al. | |
| 3,412,890 | A | | 11/1968 | Rich | |
| 3,417,897 | A | | 12/1968 | Johnson | |
| D219,958 | S | | 2/1971 | Clark | |
| 3,695,481 | A | | 10/1972 | Foster et al. | |
| 3,812,993 | A | | 5/1974 | Yoshioka et al. | |
| 3,831,798 | A | | 8/1974 | Rowe et al. | |
| 3,872,996 | A | | 3/1975 | Dogliotti | |
| 4,143,695 | A | | 3/1979 | Hoehn | |
| 4,428,497 | A | | 1/1984 | Julius et al. | |
| 4,471,881 | A | | 9/1984 | Foster | |
| D276,400 | S | | 11/1984 | Daenen et al. | |
| 4,724,977 | A | | 2/1988 | Cleevely et al. | |
| 4,848,626 | A | * | 7/1989 | Waters | 224/404 |
| 4,872,996 | A | | 10/1989 | Grierson et al. | |
| 4,898,292 | A | | 2/1990 | VerWeyst et al. | |
| 4,925,041 | A | | 5/1990 | Pehr | |
| 5,027,963 | A | * | 7/1991 | Robbins, III | 215/395 |
| D322,219 | S | | 12/1991 | Falco | |
| 5,083,671 | A | | 1/1992 | Hayes | |
| 5,085,339 | A | | 2/1992 | Roth et al. | |
| 5,092,474 | A | | 3/1992 | Leigner | |
| 5,133,470 | A | | 7/1992 | Abrams et al. | |
| 5,145,088 | A | | 9/1992 | Goujon | |
| 5,146,088 | A | | 9/1992 | Kingham et al. | |
| 5,158,190 | A | * | 10/1992 | Sosenko | 215/384 |
| 5,180,072 | A | | 1/1993 | Oehlert | |
| 5,211,301 | A | | 5/1993 | Groya et al. | |
| 5,261,544 | A | | 11/1993 | Weaver, Jr. | |
| D345,305 | S | | 3/1994 | Host | |
| D346,720 | S | | 5/1994 | Onneweer | |
| 5,358,130 | A | | 10/1994 | Mengeu et al. | |
| D351,969 | S | | 11/1994 | Daenen et al. | |
| 5,366,104 | A | | 11/1994 | Armstrong | |
| 5,423,453 | A | * | 6/1995 | Fritz | 220/608 |
| D363,218 | S | | 10/1995 | Mann | |

(Continued)

FOREIGN PATENT DOCUMENTS

| | | |
|---|---|---|
| DE | 3926140 | 2/1990 |
| DE | 3926140 A1 * | 2/1990 |
| EP | 0 990 408 B1 | 9/2003 |
| FR | 2529865 | 1/1984 |

*Primary Examiner*—Stephen Castellano
(74) *Attorney, Agent, or Firm*—Fitch, Even, Tabin & Flannery

(57) ABSTRACT

In accordance with an embodiment of the invention, a container for a product is provided. The container may include a label disposed in a midsection of the container. Upper and lower ends of the container may protrude beyond the midsection to protect the label when the container abuts against adjacent containers while providing stability to the container.

18 Claims, 4 Drawing Sheets

U.S. PATENT DOCUMENTS 5,474,199 A 12/1995 Julius et al.
5,511,684 A 4/1996 Weaver, Jr.
5,582,314 A 12/1996 Quinn et al.
5,586,681 A 12/1996 Policappelli
D381,560 S 7/1997 Indekeu
D383,671 S 9/1997 Phillips
5,669,526 A 9/1997 Keyfauver
D395,204 S 6/1998 Wood
D399,654 S 10/1998 Mandell
D407,974 S 4/1999 Zimmer et al.
5,893,489 A 4/1999 Giarrante
5,938,068 A 8/1999 Atkins et al.
D416,797 S 11/1999 Rabe et al.
6,170,719 B1 1/2001 Wilkinson et al.
D443,483 S 6/2001 Gilliam et al.
D443,508 S 6/2001 Braaten et al.
D444,027 S 6/2001 Gilliam
6,527,133 B1 * 3/2003 McCollum et al. ..... 215/382
6,575,321 B2 * 6/2003 Bourque et al. ..... 215/384

* cited by examiner

CONTAINER FOR SPOONABLE FOOD PRODUCTS

FIELD OF THE INVENTION

The invention relates generally to a container for a product, and particularly to containers adapted for automated handling.

BACKGROUND OF THE INVENTION

The prior art includes reclosable screw top jars within which spreadable foods are contained, e.g., containers for foods such as mayonnaise, Miracle Whip® dressing, other viscous dressings, jams, jellies, nut butters and spreads. Such containers are intended to permit insertion of a knife, spoon or other utensil into the container. In providing a container for this type of product, among the considerations that must be addressed are the ability of the container to receive food product in high-speed commercial filling operations; the degree of difficulty that will be encountered by the consumer in removing product from the container; the ability of the container to withstand various loads, such as stacking loads, during filling, sealing, shipping, display, and consumer use; the ability of the container to be packed efficiently among like containers; the cost of manufacture of the container; the ability of the container to exclude air to enable acceptable shelf life to be maintained, and the costs and difficulty associated with forming, filling and sealing the container. It is also important that containers of this type be aesthetically pleasing where they are intended to be displayed for commercial sale to consumers in grocery stores and/or other retail establishments.

One container that addresses the above considerations is described in U.S. patent application Ser. No. 09/579,661. This container has many advantages over prior art containers, but is thought to be susceptible to label damage and/or destabilization under certain circumstances, as explained below.

In high-speed commercial filling operations containers are often placed on a conveyor, directed to a filling station and a labeling station, then discharged from the conveyor. Often, when filled and labeled containers are discharged from the conveyor they are randomly oriented on a table or other surface where adjacent containers contact each other. This contact may damage the labels and destabilize the containers. Accordingly, it is a general object of the invention to provide a container that offers the advantages of the container described and shown in U.S. application Ser. No. 09/579,661, while also providing improved label protection and stability.

Another aspect of the invention relates to providing a container with improved handling and dispensing capabilities. Containers, in particular containers for a semi-liquid or food product, may be used in an environment where slippery material may be on the user's hands and/or the container, which may render the container difficult to handle. It is desirable to have containers sized and shaped to facilitate handling and product removal.

SUMMARY OF THE INVENTION

The invention provides a container that is uniquely configured to facilitate handling and dispensing of a spoonable product using a spoon, knife or other utensil, and that can be filled and labeled using automated machinery without label damage or instability.

In a preferred embodiment of the invention, the container is formed of a lightweight, inexpensive plastic material such that the container is capable of inexpensive mass production, and is suitable for sale as a disposable container for a product. The container may be formed using any suitable manufacturing technique, such as blow molding techniques.

The container preferably comprises a body having a bottom wall, a pair of upstanding and opposing side walls, and a pair of upstanding and opposing end walls. Opposite the bottom wall is an opening permitting access to an interior of the container defined by the bottom, side, and end walls.

The container body has an upper end, a lower end, and a mid section therebetween. The mid section of the container body may have one or more surfaces suitable for attachment of a label thereto. The label surfaces may be on one or both of the side walls, and on one or both of the end walls. The label surfaces may also extend between adjacent walls. The label may contain indicia allowing for ready identification of the contents of the container or the brand of the product within the container. The label may also be designed to provide visual appeal to the label and the container.

The upper and lower ends of the container body may have a greater cross-section than that of the mid section. The greater cross-section of the upper and lower ends may result in their protuberance beyond the mid section, and particularly beyond the label surface of the mid section. When the container abuts against similar containers, the protruding upper and lower ends of the containers may abut against each other and prevent the label surfaces from abutting. The upper and lower container ends may also be configured to reduce tipping or tilting of the container when forced against similar containers, thereby increasing the stability of the container.

The opening may be sized to be about the same or larger than the cross-section at the mid section of the container body to provide an large opening adapted for insertion of a utensil. The opening also may be oblong, having a length and a depth corresponding the side wall length and end wall length at the mid section. The container may also be sized to permit a user to grasp the container by the opposing sidewalls. The dimensions of the container may also be selected to allow the container to be placed in a typical storage shelf in a refrigerator door.

In order to facilitate handling of the container, a gripping feature may be formed on one or more of the walls. The gripping feature may comprise a ridge formed in the upper end of the container body, and in particular a crescent-shaped ridge, formed on at least one of the walls. The gripping feature may also comprise a pattern of small projections, depressions, or the like, and may be formed on at least one of the walls beneath the crescent-shaped ridge. The change in cross-section between the upper end and the mid section of the container body may also facilitate gripping of the container by a user. Similarly, the change in cross-section between the lower end and the mid section of the container body may facilitate gripping of the container.

To provide structural rigidity to the container, one or more of the walls may comprise at least a portion having an arcuate shape. The arcuate shape may be effective to provide strength to the container when abutting against other container or during filling, packaging, or other handling operations. The arcuate shape may also provide visual appeal and reduce the deformation of one or more of the container walls when a vacuum is present within the container.

To selectively permit access to the interior of the container, a lid may be secured over the opening. The lid may have an oblong shape roughly corresponding to that of the container to permit simplified insertion of a utensil for removing product. To this same end, the lid may also have a cross-section or exterior dimension about the same as or larger than the cross-section or exterior dimension of the mid section of the container body. The lid may comprise a base portion attached to the container and a hinged portion pivotably attached relative to the base portion. A clasp may be provided between the hinged and base portions of the lid to secure the lid in a position preventing access to the interior of the container. The base portion may also include a wiping feature allowing for wiping of a utensil thereagainst.

DETAILED DESCRIPTION OF THE DRAWINGS

In accordance with embodiments of the invention, a container 10 is provided that can be filled and labeled using automated machinery and is configured to reduce damage to a label 60 attached thereto without causing the container 10 to become unstable when abutting against similar containers 10.

Figure 1:
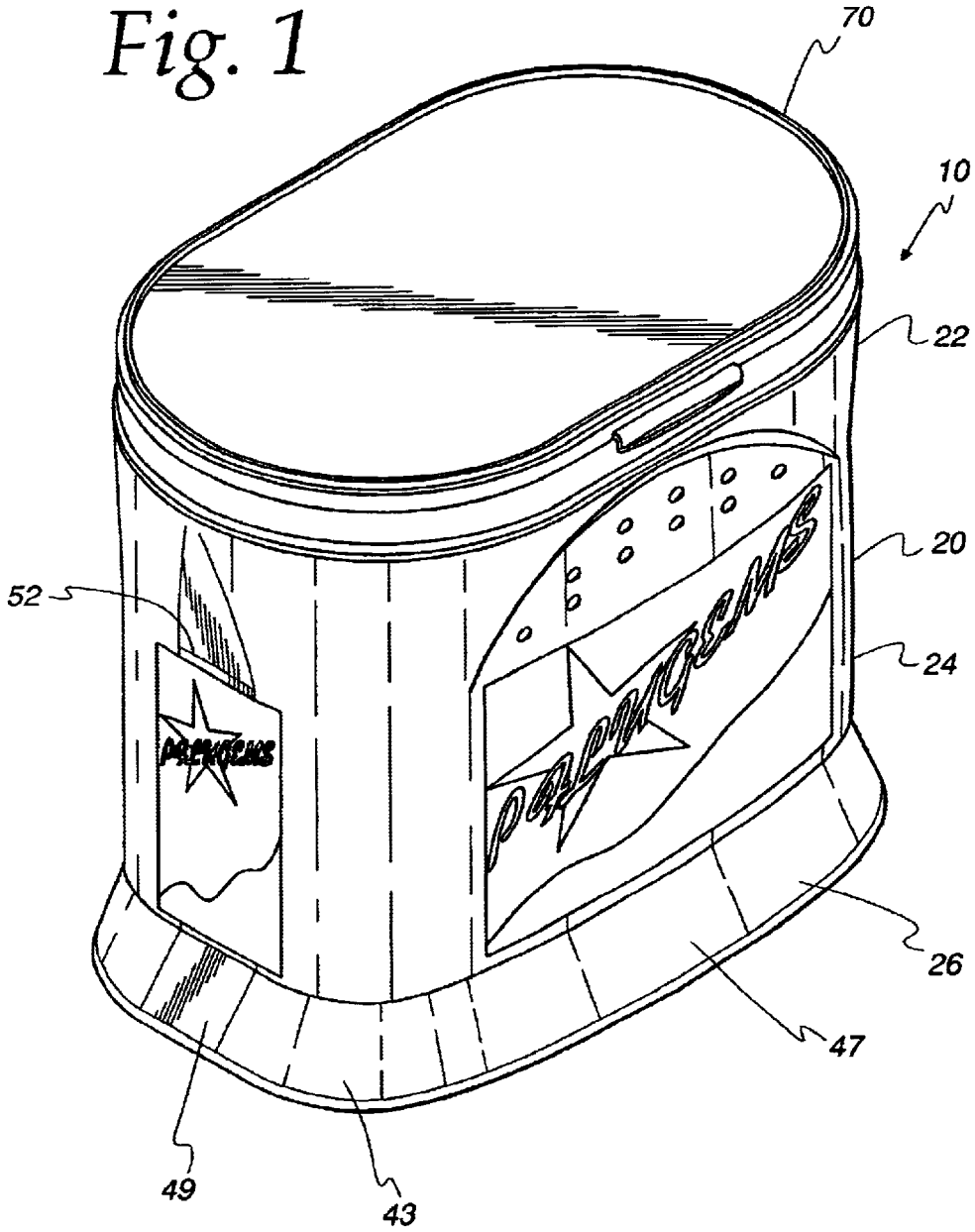
FIG. 1 is a perspective view illustrating a container in accordance with an embodiment of the invention.
Figure 2:
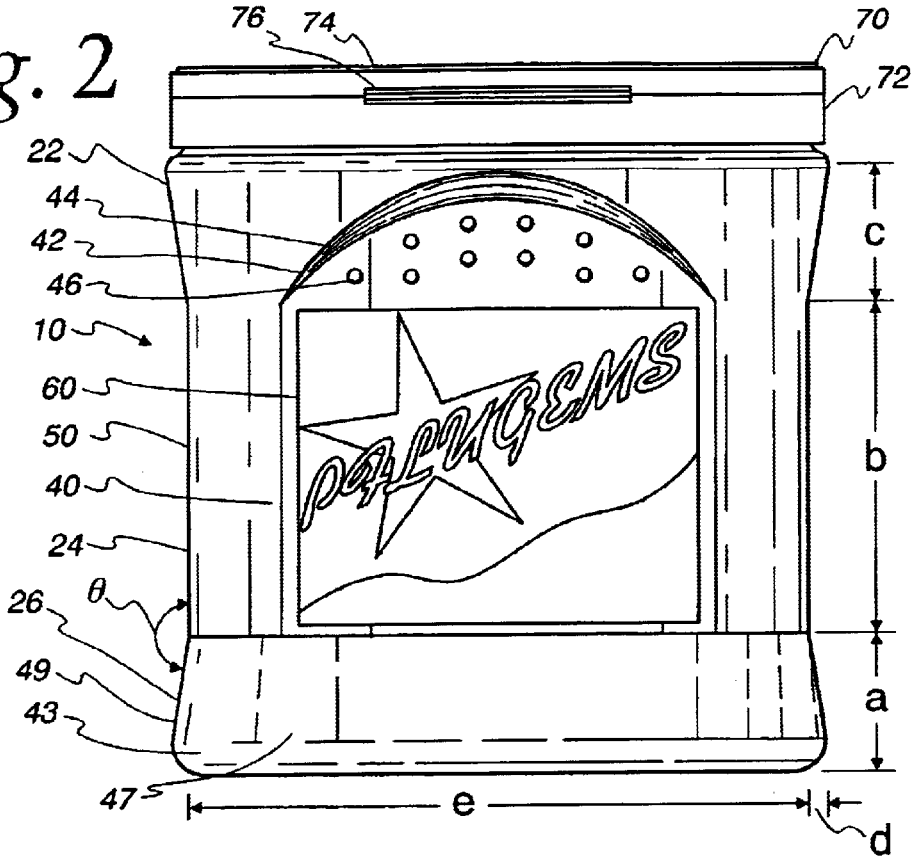
FIG. 2 is a side elevation view of the container of FIG. 1.
Figure 3:
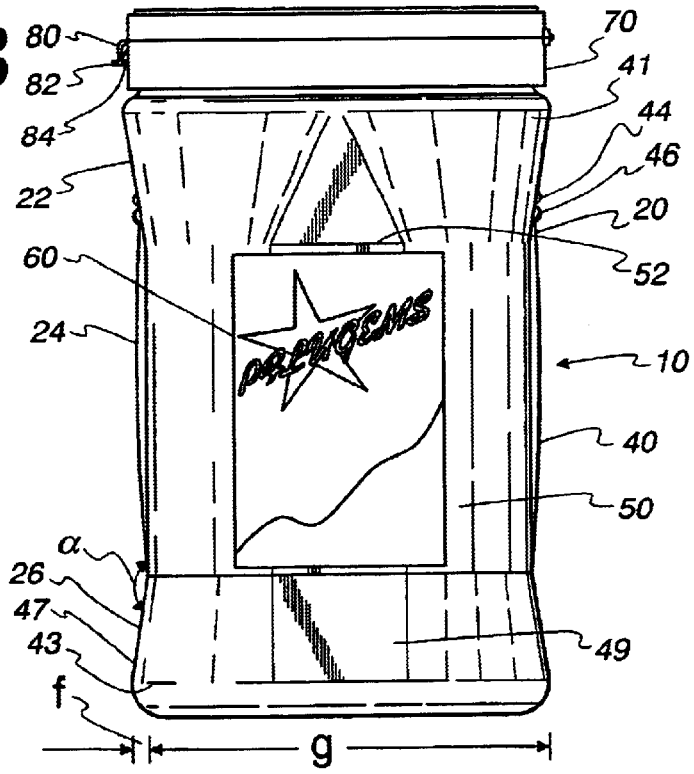
FIG. 3 is an end elevation view of the container of FIG. 1.

As illustrated in FIGS. 1–6, the container 10 comprises a body 20 having a lid 70 attached thereto. The body 20 comprises a bottom wall 30 having a pair of upstanding and opposing side walls 40 and a pair of upstanding and opposing end walls 50. The body has an upper end 22, a lower end 26, and a mid section 24 therebetween, as illustrated in FIGS. 2 and 3.

The mid section 24 of the container body 20 has surfaces for attachment of labels 60, as illustrated in FIGS. 1–3. The label 60 may contain indicia identifying the contents of the container 10, and/or the brand of the product within the container 10, and may contribute to the visual appeal of the container 10. Various label configurations are contemplated. For example, the label 60 may be placed one or both of the side walls 40. The label 60 may also be placed on one or both of the end walls 50. Moreover, the label 60 may extend between adjacent walls 40 and 50, or even wrap entirely around the mid section 24.

The mid section 24, the body upper end 22, and the body lower end 26 each have a cross-sectional dimension. The cross-sections of the upper and lower body ends 22 and 26 are each larger than the cross-section of the mid section 24 and protrude significantly therebeyond. The protruding portions are disposed on each of the side walls 40 and the end walls 50. The larger cross-sections of the upper and lower ends 22 and 26 of the body 20 are configured to reduce damage to labeling 60 on the mid section 24 while maintaining product stability.

Figure 5:
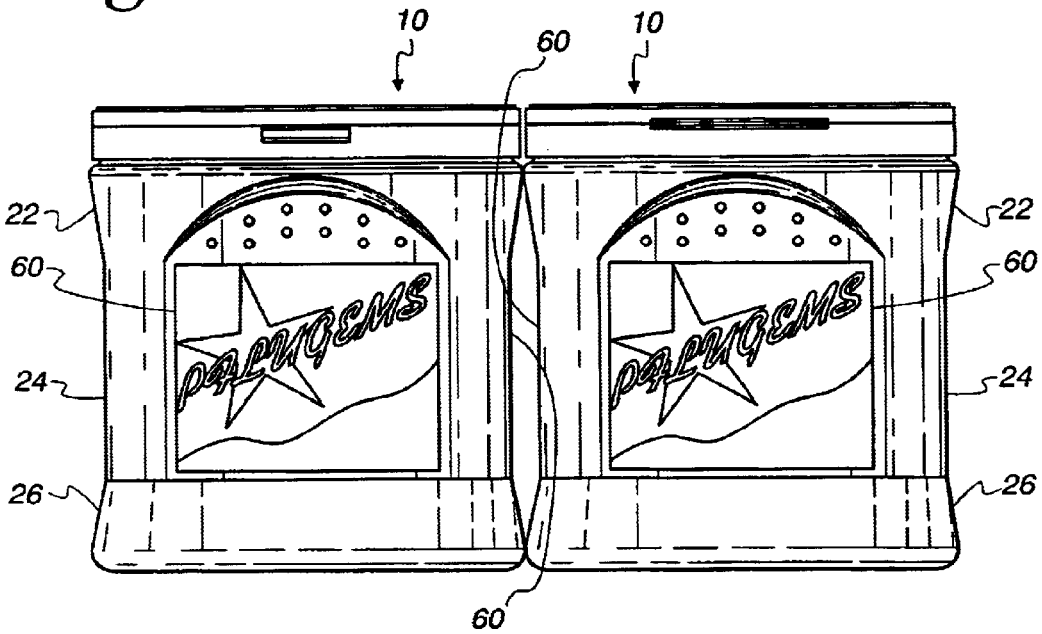
FIG. 5 is a side elevation view illustrating the container of FIG. 1 abutting against another similar container.

As illustrated in FIG. 5, when the end walls 50 of adjacent containers 10 abut, the mid sections 24 of the respective containers 10 do not contact the other container 10. The upper end 22 of each container 10 contacts only the upper end 22 of the adjacent container 10. Similarly, the lower end 26 of each container 10 contacts only the lower end 26 of the adjacent container 10. Accordingly, any label 60 on the mid section 20 of the end wall 50 is protected from damage that may mar or otherwise reduce the visual appeal and effectiveness of the label 60.

Figure 6:
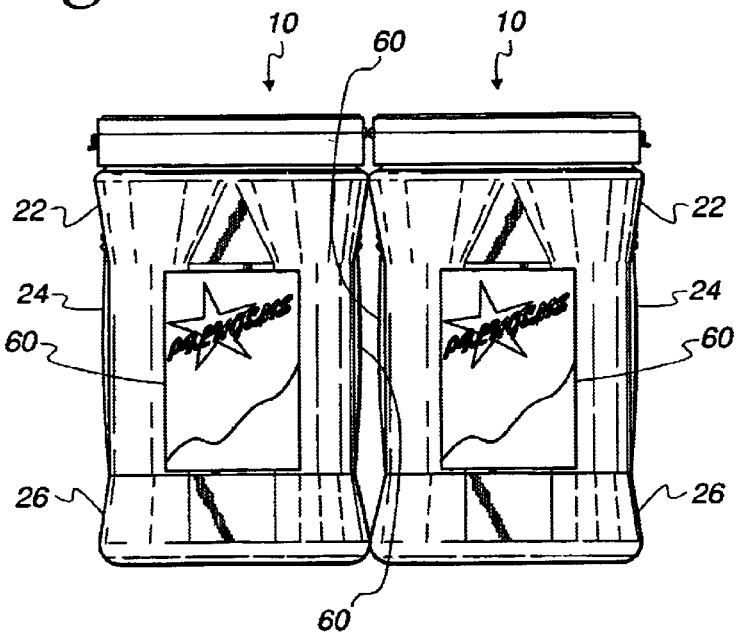
FIG. 6 is an end elevation view illustrating the container of FIG. 1 abutting against another similar container.

Likewise, when the side walls 40 of adjacent containers 10 abut, only the upper ends 22 and lower ends 26 are in contact. As illustrated in FIG. 6, the label 60 on the mid section 24 of each side wall 40 is protected from damage due to contact with the adjacent container 10.

Figure 4:
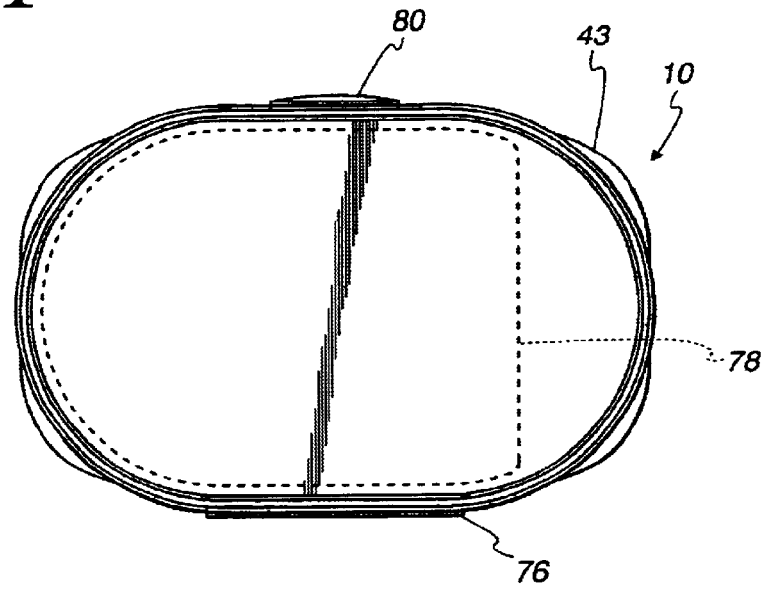
FIG. 4 is a top plan view of the container of FIG. 1.

In addition to protecting the label surfaces, the enlarged base 26 provides increased stability. The base 26 and the upper end 22 preferably have about the same length and width, but the base 26 has longer diagonals. That is, corners 43 of the base 26 protrude horizontally beyond both the mid section 24 and the upper end 22 of the container 10, as shown in FIG. 4. Each of the corners 43 of the base 26 has a smaller radius of curvature than corners 41 of the upper end 22. The similarity of dimensions between the base 26 and upper end 22 facilitate stable handling of the container 10 with other like containers, in that the containers 10 will contact each other at the top and bottom when side by side or end to end. The longer diagonals of the base 26 provide additional stability. The enlarged base 26 also lowers the center of gravity of the filled container 10.

Moreover, the greater cross-sections of the upper and lower ends 22 and 26 reduce or eliminate tilting, shingling, and toppling of the container 10 when contacted by adjacent containers 10, thereby reducing or eliminating during automated handling harm to labels 60, mishandling of the containers 10, and other undesirable results. In particular, when the upper and lower ends 22 and 26 protrude beyond the respective walls 40 and 50 an approximately similar or preferably identical distance, container tilting due to contact by similar and adjacent containers 10 is minimized.

As illustrated in FIGS. 2 and 3, the protruding upper and lower ends 22 and 26 preferably extend around the circumference of the container body 20. That is, they are similar in cross-section to the mid section 24 but longer, so that the mid section 24 is recessed on all sides. Other configurations of the upper and lower ends 22 and 26 are also contemplated. For example, the protruding portion of the cross-section may be localized, such as on the side wall 40 or end wall 50. Also, the protruding portion, or portion of increased cross-section, does not have to be on each of the walls 40 and 50.

In addition to protecting the label surfaces and improving stability, the configurations of the upper and lower ends 22 and 26 facilitate handling of the container. In particular, the transition between the upper end 22 and the mid section 24 of the container body provide a change in the contour of the body 20 that facilitates gripping thereof by a user. Similarly, the transition between the lower end 26 and the mid section 24 facilitates gripping by a user. The user may hold the container 10 by the bottom, with the user's fingers engaging one side and thumb engaging the other in the transition regions where angled base surfaces 47 and 49 meet the side walls 40 of the mid section 24 at obtuse angles.

Gripping by a user is also enhanced by providing gripping features 42 in the form of protuberances in the container body 20, as illustrated in FIG. 2. The gripping features 42 comprise a crescent-shaped protuberance 44 formed in the upper end of each side wall 40. The crescent-shaped protuberances 44 are integrally formed with the container body 20, and protrude a distance outward therefrom to allow for positive gripping by a user, as illustrated in FIG. 3. The crescent-shaped portion 44 cooperates with a portion of the container side wall to suggest the shape of a bread slice. The gripping features 42 also comprises multiple bumps 46 integrally formed with the container side wall 40 and projecting outwardly therefrom. The combination of the projecting upper and lower ends 22 and 26, portion 44, and bumps 46 facilitate gripping by a user.

To provide structural rigidity to the container 10, portions of the side and end walls 40 and 50 are arcuate. For example, the mid section 24 of the side walls 40 have a slight arcuate contour, as illustrated in FIG. 6. The arcuate contour also can prevent deformation of the side wall 40, such as by contact during handling or when the container 10 is subject to a vacuum in its interior. The arcuate surfaces of the container body 20 also provide for visual appeal of the container 10. The end walls 50 may also include a generally flat surface 52 to facilitate production of the container 10 and/or labeling.

Opposite the bottom wall 30 and in the upper end 22 of the container body 20 is an opening 28 permitting access to the interior of the container 10. The opening 28 has an oblong shape, roughly corresponding to the perimeter of the container 10. The opening 28 is sized about the same or larger than the container mid section 24. The size and shape of the opening 28 is selected to facilitate insertion of a utensil into the container body 20 for product removal.

A lid 70 is secured over the opening 28 and permits selective access to the interior of the container 10 and thus any contents therein. The exterior dimensions of the lid 70 are larger than the exterior dimensions of the container mid section 24, and are selected to be approximately flush with the upper end 22 of the container 10. The size and dimensions of the lid 70 are selected to allow for insertion of a utensil into the container 10 for product removal, while maintaining visual appeal.

The lid 70 comprises a base portion 72 secured to the container body 20 and a hinged portion 74 pivotable about a hinge 76 relative to the base portion 72 for allowing access to the interior of the container 10. The base portion 72 also includes a wiping feature 78, providing a convenient location for a utensil to be scraped to removed product therefrom, thereby retaining product within the container interior, or at least coverable with the hinged portion 74 of the lid 70, as illustrated in FIG. 4.

A clasp feature 80 is provided to secure the hinged portion 74 relative to the base portion 72, as illustrated in FIG. 3. The clasp feature 80 comprises a hook member 82 depending from the hinged portion 74 of the lid 70 and an outwardly extending rib 84 formed on the base portion 72 of the lid. When the hook member 82 engages the rib 84, the hinged portion 74 is restricted from pivoting open. To pivot the hinged portion 74 and gain access to the interior of the container 10, the hook member 72 can be manually deformed to clear the rib 84.

To further provide for improved gripping of the container 10 by a user, the dimensions of the end walls 50 are selected to allow a user to grasp both side walls 40 of the container. The container is be oblong, having side walls 40 with a greater dimension than the end walls 50. For example, the ratio of the length of the side walls 40 to the end walls is about 3:2.

The dimensions of the container 10 are selected to allow for placement within a doorway shelf or compartment of a typical refrigerator, particularly suitable when the contents of the container 10 are a perishable food product such as mayonnaise. The container 10 is sized to contain between approximately 24 and 48 ounces of mayonnaise or other product, and preferably about 32 ounces of product. The dimensions of the opening 28 are selected to facilitate insertion of utensil into the interior of the container 10, and for product removal. Although particular dimensions and ratios are described, other suitable dimensions and ratios are contemplated and considered to be within the scope of the invention.

The container 10 is preferably formed of an inexpensive polymer suitable for mass production, such as polyethylene terepthalate (PET) or another food-grade plastic. The material may be clear to allow the amount of product remaining in the container 10 to be determined without requiring the lid 70 to be opened.

As shown in FIG. 2, the ratio of the base height (a) to the total container height (a+b+c) may be between about 1:4 and 1:5.5, and is preferably about 1:4.7. The height of the base (a) may be between about 0.5 inches and 1.5 inches, and is preferably about 1 inch. The height of the mid section (b) may be between about 2 inches and 3 inches, and is preferably about 2.5 inches. The height of the upper end (c) may be between about 0.75 inches and 1.75 inches, and is preferably about 1.2 inches. The length of the base (e+2d) may be between about 4.4 inches and 5.4 inches, and is preferably about 4.6 inches. The length of the mid section (e) may be between about 4.1 inches and 5.1 inches, and is preferably about 4.6 inches. The angle ($\theta$) between the end wall 50 and the angled surface 49 of the base may be between 95 and 105 degrees.

As shown in FIG. 3, the depth of the container mid section (g) may be between 2.3 inches and 3.3 inches, and is preferably about 2.8 inches. The depth of the base portion (g+2f) may be between about 2.7 and 3.7 inches, and is preferably about 3.2 inches. The angle ($\alpha$) between the side wall 40 and the angled surface 47 of the base 26 may be between 95 and 105 degrees, and does not have to be the same as angle ($\theta$).

In accordance with a method of the invention, the above-described container 10 may be handled using automated machinery. The container 10 may be placed on a conveyor and directed to a filling station where product is loaded into the container 10. The container 10 may also have labels 60 placed thereon. The container 10 may then be unloaded from the conveyor and placed on a holding table or other surface. The unloading may be semi-random, wherein multiple containers 10 are present in a variety of different orientations with the enlarged bases 26 of the containers 10 adding to their stability. To protect the labels 60 from damage due to adjacent containers 10, the protruding upper and lower ends 22 and 26 of the container body 20 protect the mid section 24 thereof from contact by adjacent containers. Additionally, the protruding upper and lower ends 22 and 26 abut against similarly protruding upper and lower ends 22 and 26 of like containers 10, as illustrated in FIGS. 5 and 6, thereby preventing tilting or shingling of the containers 10 when adjacent containers 10 are forced against each other.

From the foregoing, it will be appreciated that the invention provides a method and apparatus for a container that can be filled and labeled using automated machinery and is configured to reduce damage to a label attached thereto without causing the container to become unstable when abutting against similar containers. The invention is not limited to the aspects and embodiments described hereinabove, or to any particular embodiments. Various modifications to the container and method of use will result in substantially the same invention.

What is claimed is:

1. A container for a product configured for automated production, the container comprising:

a body having a pair of opposing end walls, a pair of opposing side walls, and a bottom wall, the end walls each having a length and the side walls each having a length, the side wall length being larger than the end wall length to define a generally oblong body configuration, a substantial portion of the side walls not being corrugated;

a mid section of the body having a length, the side walls at the mid section being generally flat and providing a surface effective for the attachment of a label;

an upper end and a lower end of the body each having a length larger than the length of the mid section of the body, the upper end and lower end of the body being effective to provide stability to the container and protect the label surface when abutting against similar containers wherein the lower end of the body forms a base of the container and the ratio of the base height to the total height of the container is between about 1:4 and 1:5.5, the height of the mid section of the body forming from about 38.1% to about 70.6% of height of the container; and an opening at the upper end of the body, the opening having a length and a depth, the length being larger than the depth to define a generally oblong opening, the length of the opening being larger than the length of the mid section.

2. A container in accordance with claim 1, wherein the opening length is approximately the same as or larger than the side wall length at the mid section and the opening depth is approximately the same as or larger than the end wall length at the mid section.

3. A container in accordance with claim 1, wherein the upper end of the body has about the same length and width as the lower end of the body, and wherein the lower end has longer diagonal dimensions to enhance stability.

4. A container in accordance with claim 1, wherein the upper end and lower end of the body taper outward from the mid section of the body.

5. A container in accordance with claim 1, wherein the upper end of the body has,a protruding gripping feature integrally formed thereon.

6. A container in accordance with claim 4, wherein the gripping feature comprises a generally crescent shaped ridge formed on each of the side walls.

7. A container in accordance with claim 5, wherein the gripping feature comprises a plurality of raised bumps formed on each of the sidewalls.

8. A container in accordance with claim 1, wherein the side wall length and the end wall length are selected to allow the container to be placed in a door compartment of a refrigerator.

9. A container in accordance with claim 1, wherein the depth is selected to allow a hand to grasp both side walls of the container.

10. A container in accordance with claim 1, wherein a lid is attachable to the container to cover the opening.

11. A container in accordance with claim 10, wherein the exterior of the lid has a length and a depth, the lid length being greater than the side wall length at the mid section of the container and the lid depth being greater than the end wall length at the mid section of the container.

12. A container in accordance with claim 10, wherein the lid comprises a base portion attachable to the container and a hinged portion selectively movable relative to the base portion to permit access to the interior of the container.

13. A container in accordance with claim 12, wherein the base portion of the lid has a wiping portion.

14. A container for a food product the container comprising:

a body having a pair of opposing end walls, a pair of opposing side walls, and a bottom wall, the end walls each having a length and the side walls each having a length, the side wall length being larger than the end wall length to define a generally oblong body configuration, a substantial portion of the side walls not being corrugated;

a mid section of the body having a length, the side walls at the mid section being generally flat and providing a surface effective for the attachment of a label;

an upper end and a lower end of the body each having a length larger than the length of the mid section of the body, the upper end of the body having about the same length and width as the lower end of the body, the upper end and lower end of the body flare outward from the mid section of the body, the upper end and lower end of the body being effective to provide stability to the container and protect the label surface when abutting against similar containers, the end walls at the upper end of the body being rounded, the height of the upper end being from about 0.75 to about 1.75 inches, the height of the mid section being from about 2 to about 3 inches, the height of the lower end being from about 0.5 to about 1.5 inches, the lower end of the body forming a base of the container and the ratio of the base height to the total height of the container is between about 1:4 and 1:5.5; and an opening at the upper end of the body, the opening having a length and a depth, the length being larger than the depth which with the round end walls define a generally oblong opening.

15. A container in accordance with claim 14, wherein the container further includes a lid which is attachable to the container to cover the opening.

16. A container in accordance with claim 15, wherein the lid comprises a base portion attachable to the container and a hinged portion selectively movable relative to the base portion to permit access to the interior of the container.

17. A container in accordance with claim 15, wherein the base portion of the lid has a wiping portion.

18. A container for a food product, the container comprising:

a body having a pair of opposing end walls, a pair of opposing side walls, and a bottom wall, the end walls each having a length and the side walls each having a length, the side wall length being larger than the end wall length to define a generally oblong body configuration, a substantial portion of the sidewalls not being corrugated;

a mid section of the body having a length, the side walls at the mid section being generally flat and providing a surface effective for the attachment of a label;

an upper end and a lower end of the body each having a length larger than the length of the mid section of the body, the upper end of the body having about the same length and width as the lower end of the body, the upper end and lower end of the body tapering outward from the mid section of the body, the upper end and lower end of the body being effective to provide stability to the container and protect the label surface when abutting against similar containers, the end walls at the upper end of the body being rounded, the height of the upper end being from about 0.75 to about 1.75 inches, the height of the mid section being from about 2 to about 3 inches, the height of the lower end being from about 0.5 to about 1.5 inches, the lower end of the body forming a base of the container and the ratio of the base height to the total height of the container is between about 1:4 and 1:5.5;

an opening at the upper end of the body, the opening having a length and a depth, the length being larger than the depth to define a generally oblong opening; and an attachable lid to cover the opening, the lid comprising a base portion attachable to the container and a hinged portion movable relative to the base portion to permit access to the interior of the container, the base portion including a wiping portion.

* * * * *